US006425205B2

(12) United States Patent
Wygle et al.

(10) Patent No.: US 6,425,205 B2
(45) Date of Patent: Jul. 30, 2002

(54) VEHICLE LIFTGATE POWER OPERATING SYSTEM

(75) Inventors: Michael G Wygle, Madison Hights; Ian Martin, Waterford; Douglas Dombrowski, Troy; Howard Warren Kuhlman, Rochester Hills, all of MI (US)

(73) Assignee: Delphi Technologies, Inc., Troy, MI (US)

( * ) Notice: Subject to any disclaimer, the term of this patent is extended or adjusted under 35 U.S.C. 154(b) by 0 days.

(21) Appl. No.: 09/777,030

(22) Filed: Feb. 5, 2001

Related U.S. Application Data

(60) Provisional application No. 60/192,944, filed on Mar. 29, 2000.

(51) Int. Cl.[7] ..... E05F 15/08
(52) U.S. Cl. ..... 49/349; 296/56
(58) Field of Search ..... 49/339, 340, 341, 49/348, 349; 296/56

(56) References Cited

U.S. PATENT DOCUMENTS

| | | | | |
|---|---|---|---|---|
| 3,713,472 A | | 1/1973 | Dorois | |
| 3,716,945 A | | 2/1973 | Cooper et al. | |
| 4,182,078 A | | 1/1980 | Bartholomew et al. | |
| 4,257,192 A | | 3/1981 | Bartholomew | |
| 4,541,293 A | * | 9/1985 | Caugant et al. | 74/89.18 |
| 4,903,435 A | | 2/1990 | Bittmann et al. | |
| 4,967,510 A | | 11/1990 | Torii et al. | |
| 4,979,261 A | | 12/1990 | Lasier et al. | |
| 5,209,057 A | | 5/1993 | Remlaoui | |
| 5,448,856 A | | 9/1995 | Moore et al. | |
| 5,449,212 A | | 9/1995 | Seifert | |
| 5,477,642 A | | 12/1995 | Legendre | |
| 5,507,120 A | | 4/1996 | Current | |
| 5,513,467 A | | 5/1996 | Current et al. | |
| 5,531,498 A | | 7/1996 | Kowall | |
| 5,563,483 A | | 10/1996 | Kowall et al. | |
| 5,588,258 A | | 12/1996 | Wright et al. | |
| 5,630,637 A | | 5/1997 | Sauri | |
| 5,851,050 A | | 12/1998 | Squire et al. | |
| 5,896,703 A | | 4/1999 | Wright et al. | |
| 6,055,775 A | | 5/2000 | Dering et al. | |
| 6,092,337 A | * | 7/2000 | Johnson et al. | 49/340 |
| 6,137,249 A | * | 10/2000 | Butler et al. | 318/266 |
| 6,142,551 A | * | 11/2000 | Ciavaglia et al. | 296/56 |
| 6,283,535 B1 | * | 9/2001 | Yuge | 296/146.8 |
| 6,318,025 B1 | * | 11/2001 | Sedlak | 49/341 |

FOREIGN PATENT DOCUMENTS

| | | |
|---|---|---|
| DE | 2007130 | 11/1971 |
| DE | 3513127 | 10/1986 |
| JP | 2000080840 | 3/2000 |

* cited by examiner

*Primary Examiner*—Curtis Cohen
(74) *Attorney, Agent, or Firm*—Kathryn A. Marra

(57) ABSTRACT

A power operating system for opening and closing a vehicle liftgate has a pair of drive units supported on the vehicle roof and connected to the liftgate for opening and closing the liftgate. Each drive unit includes a housing having a curved track and a curved gear rack that is bodily movable endwise in the housing and guided by the curved track, the rack also serving as the drive link between the housing and the liftgate. The combined rack and drive link is extended and retracted by a pinion gear that is journalled interiorly in the housing and engages the teeth of the curved gear rack. The pinion gear is rotated by the output shaft of the motor, which in turn is fastened to the side of the housing. The motor is a reversible electric motor and is adapted to be operably coupled to the vehicle ECU unit and preferably includes an internal transmission and electrically operated clutch controlled by the ECU unit.

20 Claims, 3 Drawing Sheets

VEHICLE LIFTGATE POWER OPERATING SYSTEM

This is a regular utility patent application filed under 35 U.S.C.§111 (a) claiming the benefit under 35 U.S.C. § 119 (e) of provisional application Ser. No. 60/192,944, filed Mar. 29, 2000 pursuant to 35 U.S.C. § 111 (b).

TECHNICAL FIELD

This invention relates to a power operating system for a vehicle liftgate that is pivotally attached to a vehicle compartment for pivotal movement about a hinge axis that in normal orientation extends horizontally, and more particularly to a power operating system that will move such a liftgate from and between fully closed and fully open positions.

BACKGROUND OF THE INVENTION

Utility vehicles, vans and station wagons with rear liftgates that are hinged at the top about a generally horizontal axis are used by large numbers of people today. Some of these liftgates are large and heavy, thus making them difficult to open and close. Some of the liftgates also reach a great distance above the ground when they are fully opened, thereby making them very difficult for people of shorter height to close. For these and other reasons many people would like to have a power operating system for opening and closing the liftgate.

A number of different liftgate openers have been tried in recent years. Some of these liftgate openers have a single cable that opens and closes a liftgate in connection with a counterbalance system, such as a gas spring counterbalance system. Liftgates and similar hinged body panels that are provided with a single cable opener and closer are generally lightweight and have a relatively small range of movement, such as trunk lids. Moreover, gas spring output varies with temperature. This complicates power liftgate systems that rely on gas springs to assist in opening the liftgate. The gas spring or springs must be strong enough to open the liftgate on the coldest day (−40° C.). This results in gas springs that increase closing resistance substantially on the hottest day (80° C.). Therefore, a very large electric motor must be used to close the liftgate.

Liftgates that have two or more gas springs for a counterbalance system are common. These gas springs generally occupy a position in which their axis is substantially parallel to the liftgate so that the gas springs are hidden when the liftgate is closed. In this closed position the moment arm of the gas springs is quite small. With such systems the liftgate may move about one-third of its total travel range before the gas cylinders exert sufficient force to open a liftgate further without the application of an independent lifting force. There are even some systems in which the gas springs pass over center and bias a liftgate toward a closed position when the liftgate is closed. With these self-closing systems a liftgate may need to be more than one-third open before the gas springs will open the liftgate further.

The force required to hold a liftgate in a given position along its path of movement from a closed position to a fully open position varies substantially in some liftgate opening systems. A power liftgate closer must exert sufficient force to hold a liftgate in any given position along the path of movement, plus the force to overcome friction, and plus the force required to accelerate the liftgate during liftgate closing. If the total force exerted by the liftgate power closure varies substantially from one position between fully opened and closed to another position between fully opened and closed, it may be difficult for the control system to detect an obstruction and stop the liftgate without incurring damage to the vehicle or to the object that obstructs the liftgate.

It is also important that a liftgate opener have as few stationary and moving parts as possible and be a compact design in order to provide minimum obstruction to the cargo opening closed by the liftgate. The liftgate power operating system also should be operable to allow the liftgate to be moved manually, even when equipped with a power operated liftgate system, and should be usable alone (uncounterbalanced) and in conjunction with a liftgate counterbalancing system.

OBJECTS OF THE INVENTION

Accordingly, among the objects of the present invention are to provide an improved vehicle liftgate power operating system that can be remotely controlled and electrically powered to move the associated liftgate from and between fully closed and fully open positions, usable in conjunction with a counterbalance system, electrically powered and capable of remote control, such as by the vehicle ECU unit, that is compact, rugged, requires a minimum of moving and stationary parts, economical to manufacture and maintain, easier to package than prior systems and provides better clearance with the vehicle head envelope than prior systems, lighter in weight, which is easily sealed against intrusion by car wash and rain water and against expulsion of lubricant contained in the liftgate power operating mechanism, which can be employed with single or dual output shaft electric motors, and that overcomes the aforementioned as well as other disadvantages of the prior art.

SUMMARY OF THE INVENTION

In general, and by way of summary description and not by way of limitation, the invention accomplishes one or more of the foregoing objects by providing an improved vehicle liftgate power operating system wherein an arcuate' clam shell type housing movably encases a curved rack gear subassembly of complemental curvature to the housing and that is movable bodily endwise therein and protrudes at one end from an end opening of the housing so as to also function as a drive link that is pivotally coupled to the liftgate. Preferably a pair of curved runner bars flank the rack gear and are fixed thereto and protrude therebeyond for coupling by a clevis pin and clevis bracket to provide the pivotal coupling of the rack gear subassembly to the liftgate. The housing is pivotally coupled to a hinge bracket that mounts the housing to the vehicle so that the entire housing can swivel about the mounting pivot connection.

In one embodiment, an electric motor is directly mounted to the side of one of the housing half-shell parts and has a drive shaft that extends into the housing and is coupled in driving relation to a pinion gear disposed in constant mesh with the teeth of the curved rack. The rack subassembly is movably roller-supported within the housing by runner wheels attached to the rear ends of runner bars that track in the housing and by riding on a wheel mounted interiorly on the housing near its exit end. Dual hubs on the pinion gear overlie the smaller radius edges of the runner bars such that, in cooperation with the roller engagement of the runners within the housing, the rack is accurately maintained in any travel position during its bodily motion relative to the housing, the appropriate constant mesh tooth engagement is maintained between the pinion and rack during operation, and frictional resistance in the drive mechanism is substantially reduced. The pivotal mounting of the housing on the vehicle helps compensate for vehicle liftgate/body hinge mount assembly tolerance variations. The curvature of the housing and associated rack gear subassembly is uniform about a common center of curvature which in turn is coincident with the pivot axis of the liftgate-hinge. Thus insures a constant 1:1 ratio in the drive linkage action throughout operational travel of the rack gear subassembly in operating the liftgate between its fully closed and fully open positions.

In a second and preferred embodiment of the invention also disclosed herein, the clam shell housing is modified to provide a motor mounting bracket portion at the exit end of the housing, and the rack gear is provided with gear teeth on its larger diameter lower edge, rather than on its smaller diameter upper edge as in the first embodiment. The pinion gear is directly mounted on the output shaft of the motor drive unit, and again is in constant mesh with the gear teeth of the rack. A pair of rollers are mounted in the motor mounting bracket portion of the housing and rotatably engage, support and guide the radially opposite inner and outer edges of the runners that flank the rack gear. The curved housing track, on which runs the roller journaled at the rear end of the rack subassembly, is formed as a laterally outwardly protruding embossment on each housing half-shell. The surrounding peripheral marginal portion of each housing half-shell lies in a plane offset from the plane of the embossment and is provided with mounting bosses for receiving housing fasteners and for journal attachment of the housing swivel bracket subassembly. Preferably the motor drive unit is right angle drive type having an electromagnetically operated clutch transmission mounted to the motor unit so that the motor extends compactly alongside the housing.

BRIEF DESCRIPTION OF THE DRAWINGS

The foregoing as well as other objects, features and advantages of the present invention will become apparent from the following detailed description, appended claims and accompanying drawings wherein:

DETAILED DESCRIPTION OF THE PREFERRED EMBODIMENTS

The following description of the preferred embodiments is merely exemplary in nature, and is in no way intended to limit the invention, its application, or uses. For example, the power liftgate assemblies disclosed herein may have utility in a variety of automotive vehicles such as sedans, hatchbacks, station wagons, vans, sport utility vehicles, trucks and the like.

Figure 1:
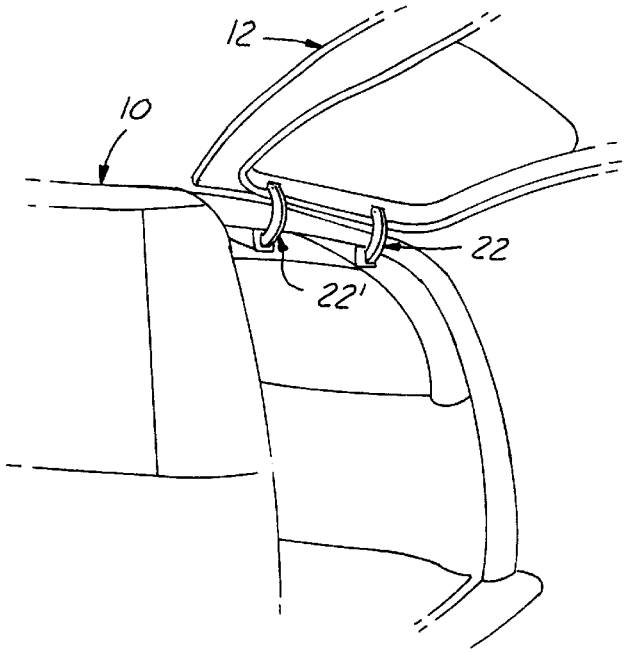
FIG. 1 is a fragmentary perspective view of the rear portion of a vehicle equipped with a liftgate power operating system of the invention showing the liftgate in an open position.
Figure 3:
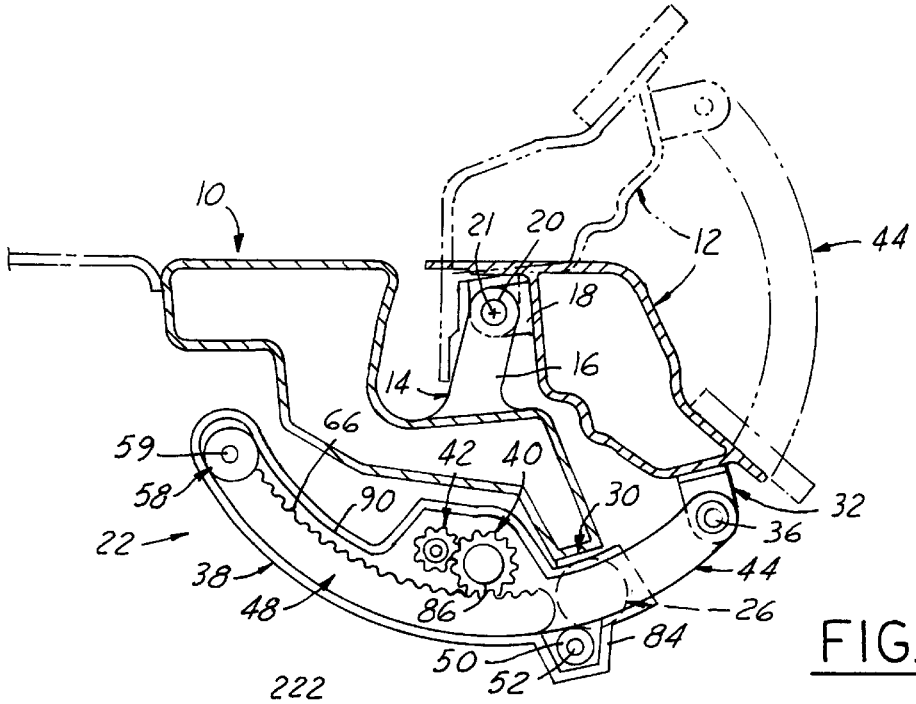
FIG. 3 is an enlarged side view of the right hand drive unit of the power operating system of FIG. 1 taken partially in cross section, with certain of the parts broken away to show internal details when the liftgate is fully closed, and showing in phantom the relationship of the parts when the liftgate is fully open.

Referring to the drawings, FIG. 1 fragmentarily illustrates a vehicle 10 having a liftgate 12 that is attached to the aft end of the vehicle roof by conventional hinge assemblies. The typical starboard or right hand hinge assembly 14 is shown in FIG. 3, the port or left-hand hinge assembly being identical thereto and not shown. Hinge assembly 14 has a hinge bracket 16 that is secured to a roof channel of vehicle 10 and a hinge leaf 18 that is secured to a top channel of liftgate 12. Hinge leaf 18 is attached to hinge bracket 16 by a pivot pin 20 so that liftgate 12 pivots about a hinge axis, indicated at 21 in FIG. 3, from and between a fully closed position shown in solid lines in FIG. 3 to a fully open position shown in phantom in FIG. 3. Hinge axis 21 is oriented so as to extend generally substantially horizontally when the vehicle is likewise oriented, and liftgate 12 is generally permitted to pivot through an angle or travel range of about 90° about hinge axis 21. However, this range of pivotal movement of liftgate can be varied substantially from one model of vehicle 10 to another.

Liftgate 12 is opened and closed by a power operating system of the present invention that preferably includes two identical drive units 22 and 22' (FIG. 1) that are preferably interiorly installed (interiorly of the vehicle weather seal system) on the aft end of the vehicle roof. Drive units 22 and 22' are laterally spaced from each other and mounted near the respective starboard and port vertical body pillars at the aft end of the vehicle that define the rear access or cargo opening that is closed by liftgate 12.

FIRST EMBODIMENT

The starboard drive unit 22 of the first embodiment is shown in FIG. 3 with an interior trim cover removed to show details of the drive unit. The individual components of each first embodiment drive unit 22, 22' are best seen in the exploded perspective assembly view of FIG. 2 and include the following components:

| Part | Ref. # |
|---|---|
| Reversible DC Electric Drive Motor | 24 |
| Swivel bracket bushings | 26, 28 |
| Swivel bracket | 30 |
| Clevis bracket | 32 |
| Clevis pivot pin | 36 |
| Starboard or Right hand housing | 38 |
| Dual hub rack pinion gear | 40 |
| Motor spur gear | 42 |
| Starboard rack runner | 44 |
| Starboard rack runner roller | 46 |
| Arcuate segment gear rack | 48 |
| Housing roller | 50 |
| Housing roller axle pin | 52 |
| Runner/rack fastening pins | 54 |
| Port rack runner | 56 |
| Port rack runner roller | 58 |
| Port or left hand housing | 60 |

Figure 2:
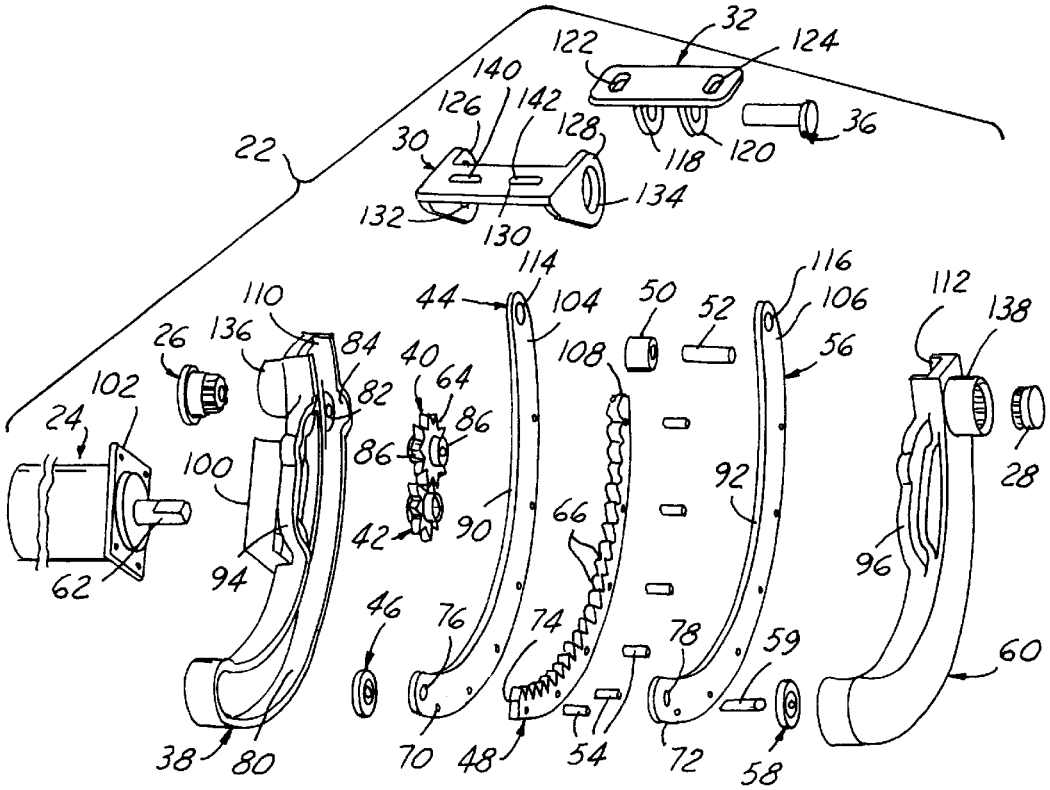
FIG. 2 is an exploded perspective view of the components of a first embodiment of the liftgate power operating system of the invention shown by themselves apart from the vehicle.

As best seen in FIGS. 2 and 3, each drive unit 22, 22' provides a rack and pinion type drive system powered by electric motor 24. Spur gear 42 is attached to the axle output shaft 62 of motor 24, and gear drives rack pinion 40 which in turn is mounted in the clam shell housing 38/60 so that its teeth 64 drivingly mesh with the teeth 66 of rack 48 in a constant mesh relationship.

The rack subassembly 44–58 comprises the arcuate runners 44 and 56 which are mounted in flanking fixed relationship to the opposite sides of rack 48 by the fastener pins 54, which preferably are in the form of rivets or similar peened pins. The respective rear ends 70 and 72 of runners 44 and 56 protrude slightly beyond the rear end 74 of rack 48 to provide clearance for mounting a roller axle pin 59 through openings 76 and 78 in runners 44 and 56 respectively. Axle pin 59 rotatably mounts runner rollers 46 and 58 against the outboard sides of runners 44 and 56 respectively. Runner roller 46 is designed to roll on the track formed by the larger diameter curved wall 80 of starboard housing shell38, and roller 58 is likewise designed to roll on the track surface of the similar wall (not seen) provided in the identical mirror image port housing shell 60.

Housing roller 50 is jounalled on axle pin 52 that in turn is supported at one of its axially opposite ends in a pocket 82 in housing 38 and in a like pocket in housing 60 (not shown), these housing journal pockets being coaxially aligned in assembly. Each housing shell 38 and 60 is provided with a semi-cylindrical pocket 84 in its outer, larger diameter curved wall 80 for nestably receiving roller 50 so that in assembly the roller periphery protrudes slightly radially inwardly of the track surface 80.

Pinion 40 is provided with axially oppositely protruding coaxial hubs 86 and 88 of like diameter that in assembly are spaced with a slight precision clearance fit adjacent the smaller diameter side edges 90 and 92 of runners 44 and 56 respectively. Hubs 86 and 88 are respectively journalled in journal pockets (not shown) provided in the associated radially inwardly protruding gear cage portions 94 and 96 of housings 38 and 60 respectively. Gear cages 94 and 96 are also designed to provide space to operationally accommodate the motor drive gear 42 in offset, non-engaging relationship with the teeth 66 of rack 48. The outer side of gear cage 94 has a mounting plate 100 that mates with a mounting bracket 102 provided on motor unit 24 and that is secured thereto by four fasteners (not shown). The motor output shaft 62 protrudes through a suitably sealed opening in plate 100 and into the interior space of cage 94, and receives keyed thereon the motor spur gear 42.

Preferably the gear set 40–42 is designed as a conventional "teeter-totter" gear set for driving rack 48 at a 1:1 ratio gear drive relationship with motor output shaft 62. Preferably motor unit 24 is a reversible DC drive servo-motor drive unit that includes a solenoid operated clutch for coupling an internal gear reduction drive unit to output shaft 62 under the control of the conventional control system for motor unit 24. This control system in turn is electronically operably coupled to the conventional electronic control unit (ECU) of the vehicle and is programmed for operation as described hereinafter.

The forward ends 104 and 106 of runners 44 and 56 protrude beyond the forward end 108 of rack 48 so as to be always disposed exteriorly of the open exit ends 110 and 112 of housings 38 and 60 respectively, i.e., even in the fully retracted position of rack 48 within the housing. Runner protruding ends 104 and 106 are provided with mounting holes 114 and 116 respectively which receive the associated axially opposite ends of clevis pin 36 therethrough for pivotally mounting clevis 32 to runners 44 and 56. Clevis 32 is provided with a pair of ears 118 and 120 that in assembly flank protruding ends 104 and 106 of the runners and that are apertured to receive pin 36 therethrough coaxially with runner holes 114 and 116. Clevis 32 is also provided with a pair of mounting slots 122 and 124 that are made oblong in the longitudinal direction of the vehicle for receiving suitable mounting fasteners for adjustably attaching clevis 32 to a suitable location on the frame of liftgate 12.

Hinge bracket 30 has a pair of ears 126 and 128 extending perpendicularly to a web portion 130 of bracket 30 and is provided with coaxially aligned journal openings 132 and 134 respectively. Housing shells 38 and 60 are each respectively provided with a bushing socket 136 and 138 affixed to the outer surface of each housing adjacent the upper exit end of the same. Hinge ears 126 and 128 are designed to flank sockets 136 and 138 in assembly therewith so as to coaxially align bracket ear openings 132 and 134 with the bushing sockets. When bracket 30 is so positioned, bushings 26 and 28 are inserted through the hinge ear openings 132 and 134 respectively and seated into sockets 136 and 138 to thereby serve as the journal bushings for effecting pivotal motion of the housing relative to hinge bracket 30. Bushings 26, 28 are each provided with a fluted end section or other type of male keying structure that cooperates with a complementary female keying structure provided within each of the bushing sockets 136 and 138 to thereby prevent rotation of bushings 26 and 28 relative to the housing. Suitable fasteners are inserted through a central bore of each bushing 26, 28 to affix the same securely within the associated bushing socket 136, 138.

Hinge bracket 30 has a pair of mounting openings 140 and 142 that are oblong in a direction transverse to the longitudinal dimension of vehicle 10. Bracket 30 is thereby adjustably fastened to the vehicle body by fasteners extending through openings 140 and 142 and preferably into the transverse aft upper rear channel of the vehicle body of vehicle 10, as best seen in FIG. 3. When drive unit 22 is so mounted to vehicle 10 and coupled by clevis 32 to liftgate 12 (FIG. 3), the drive unit assembly 22 has a freedom of movement about the pivot axis of hinge 30 on bushings 26, 28. This degree of freedom of mounting, plus the adjustment provided by the oblong slots 140 and 142 in hinge bracket 30 and the oblong slots 122, 124 in clevis bracket 32, enables the drive unit mounting to accommodate manufacturing assembly tolerance variations in the body of vehicle 10 versus the hinge-mounted relationship thereto of liftgate 12.

It will also be understood that in the mounted relationship of drive 22 to vehicle 10 and liftgate 12, the constant and matching radii of curvature of gear rack 48, of runners 44 and 56, and of housing halves 38 and 60 are all centered on the axis 21 of the vehicle/liftgate hinge 16/18. Such concentric curvature orientation enables the runner/rack subassembly 44/48/56 to travel bodily endwise in and out of housing sub-assembly 38/60 during operation of the drive unit in a curved travel path that is concentric with the hinge axis 21.

The power operating system of the invention further includes a conventional power source, such as the vehicle battery (not shown), and a suitable motor control provided in the conventional electronic control unit (ECU) of the vehicle programmed for energizing and shutting off the reversible electric motor 24. Motor controls are well known to those skilled in the art and thus need not be described in detail.

The foregoing illustrative first embodiment of the vehicle liftgate power operating system of the invention operates as follows: Assuming that liftgate 12 is closed as shown in solid lines in FIG. 3, electric motor 24 is energized to open liftgate 12. When so energized, electric motor 24 normally has its internal clutch engaged to couple the internal worm gear reduction unit to the motor output shaft 62 with a suitable gear reduction of say 20:1 therebetween. The armature of the motor thereby rotates output shaft 62 clockwise to thereby drive motor spur gear 42 clockwise, which in turn drives pinion gear 40 counterclockwise. This causes pinion 40, through its constant mesh with teeth 66 of rack segment 48, to drive the rack segment 48 counterclockwise so that the same moves bodily on its roller-guided mounting in housing 38/60 to thereby progressively extend the runner rack sub-assembly 44/48/56 in outward protruding relation to the exit end 110/112 of housing 38/60. Electric motor 24 is programmed to continuously so drive gears 42/40 until the rack/runner sub-assembly 44/48/56 is driven to the fully extended position shown in phantom FIG. 3. This action raises liftgate 12 from the fully closed position shown in solid lines in FIG. 3 to the fully open position shown in FIG. 1 and in phantom in FIG. 4. When liftgate 12 is fully opened, a limit switch or a like current-sensing tracking circuit in the ECU is actuated to shut off electric motor 24.

Liftgate 12 is closed by the motor control system causing the electric motor to be driven in reverse so that output shaft 62 rotates counterclockwise and likewise the gear set 40/42, thereby driving rack 48 back to the retracted position shown in solid lines in FIG. 3. With a suitably configured and equipped motor control circuit in the ECU, motor 24 can be de-energized at any time, and liftgate 12 can be stopped in its travel at any intermediate position under operator control and with the internal motor clutch thereupon disengaged. The liftgate 12 is then releasably held in any such intermediate stopped position by the friction in gear set 42/40/48 without any need for a brake, detent or the like. Liftgate 12 can then be further power moved by energizing motor unit 24 and its power-operated clutch from the engine control unit under operator dashboard control. Whenever the system decouples the motor internal gear reduction unit from the motor output shaft 62, the liftgate can be moved manually because gear set 42/40/48 can be designed with sufficient efficiency and preferably with a 1:1 reduction ratio that readily permits manual forces applied to the liftgate to manually back or forward drive the clutch-decoupled housing-encased gear set.

The first embodiment power operating system as described hereinabove preferably includes two identical drive units 22, 22' mounted as diagrammatically indicated in FIG. 1 for balanced operation and reduced manufacturing costs. However, the drive units need not be identical, and in some instances a single drive unit 22 may be sufficient. In addition, the two drive motors 24 may be eliminated and a single similar type motor gear reduction unit with a built-in clutch substituted that has a pair of drive shafts protruding one from each of the axially opposite ends of the motor casing. Such a unit may be interiorly centrally mounted to the aft rear body roof between such two motorless drive units 22 and 22', and then coupled to the spur gears 42 thereof by flexible drive shafts that are suitably encased in flexible covers that prevent contamination of the vehicle interior.

From the foregoing description, it will now be apparent to those of ordinary skill in the art, that the first embodiment vehicle liftgate power operating system of the invention provides many features and advantages that amply fulfill one or more of the aforestated objects. It will be seen that the runners 44 and 56 that flank radial gear segment rack 48 hide the rack from view and keep the rack in accurate travel position by the engagement of the wheels 46 and 58 attached to the runners, the tracking of the hubs of pinion 40 on the upper edges 90 and 92 of the runners and the cooperative runner wheel 50 journalled in the housing 38/60 underneath the runners 44 and 56 so that their lower edges track on wheel 50. This three-point engagement system of roller bearings provides a stable, low friction movable mount of the runner/rack sub-assembly 44/48/56 in the housing components 38/60. All of this is packaged conveniently within the clam shell housing that in turn utilizes the pivoting bracket 30 to help correct vehicle door/hinge tolerance assembly variations.

The utilization of the runner/rack sub-assembly 44/48/56 to function as the combined drive gear, guide rails and coupling link of the drive system advantageously reduces the number of parts and enables a system construction to be very compact for packaging. This design also is reliable and low cost, and has predictable performance. With fewer components and mounting locations, the direct drive radial unit of the invention is thus more compact and easier to package for certain vehicles than is the case with other liftgate power operating systems. Weight reduction and part reduction advantages are also thus provided by the system of the invention.

Improved clearance with the vehicle overhead envelope is also obtained as compared to previous header mounted systems. Neither the housing gear drive 42–40 nor the rack gear 48 are exposed in the closed condition of the liftgate. The housing can be lubricated with grease during initial manufacturing assembly fill, as well as periodically serviced with addition of lubricant grease without danger of such running out of the housing (particularly if the same is suitably sealed). A joint gasket between housing clam shell components 38 and 60 may be readily designed and provided for this purpose (not shown). In the preferred embodiment illustrated in FIG. 2, the components 38, 44, 48, 56 and 60 can be made as metal stampings in an economical manner for high volume mass production. However, it is also possible within the scope of the present invention to make the housing components 38 and 60 from aluminum alloy by prevision die casting processes, or by injection molding processes from high strength filled plastic materials. Overlapping seal joints can be thereby cast or molded in, as well as suitable journal hubs for wheel axle 52 and the hubs of gear 40 and the shaft for gear 42, so that these components are precision mounted in an economical and reliable manner. Likewise, the runner/rack sub-assembly 44/48/56 can be made in one piece as a molded unit or as a one-piece sintered metal part, if desired. The exit ends 110 and 112 of housing 38 and 60 in assembly may be fitted with a close fitting apertured axial flexible seal member to better ensure entrapment of grease or other suitable lubricant within the housing, both during on and off duty cycles of the drive unit.

If desired, the gear set 42–40 may be rearranged in a conventional gear drive manner to vary the gear reduction drive ratio from 1:1 to a step-up ratio or even a step-down ratio. Motor drive unit 24, as provided with the internal gear reduction transmission and external clutch mechanism and controlled by the vehicle ECU, can be programmed in a conventional manner to reverse itself, as well as to disengage the clutch when the liftgate encounters an obstruction.

It is also to be noted that the drive system of the invention rotates about a center line of the hinge mechanism, i.e., hinge axis 21, about a constant radius of curvature in the travel path end of the one-piece drive linkage. This geometry simplifies the control system insofar as the rate of closure movement of the liftgate remains the same throughout 100% of its travel, and likewise as to the drive linkage. Thus, there is no variation in the mechanical advantage developed in the drive linkage/drive train between the motor and the liftgate regardless of whether the liftgate is being driven in an opening motion or a closing motion. In addition, although the roller bearing mount of the rack/drive link in the housing is preferably designed for a close tolerance engagement to ensure accurate motion of the moving drive link relative to the housing support, nevertheless the same will not bind up because the single point pivotal suspension of the housing on the vehicle helps eliminate mounting stresses due to vehicle body to liftgate mis-alignment problems. Drive units 22, 22' can also be mounted outside the vehicle-to-liftgate gasket weather sealing system because they are readily sealed from the intrusion of rainwater and car wash water, but of course can be mounted interiorly within the liftgate vehicle body door seals.

It will also be noted that the dual hubs 86 and 88 of the rack drive gear 40 riding on the upper edges 90 and 92 of runners 44 and 56 ensures a constant tooth depth meshing interengagement between the teeth of pinion 40 and teeth 66 of rack 48 so that stresses and forces during operation of the system do not force over-meshing of the gear teeth and thereby produce premature gear wear.

If it is desired to accommodate an even greater degree of misalignment between liftgate and vehicle body than enabled by the single-axis swivel mounting (through hinge bracket 30) of housing parts 38 and 60, hinge bracket 30 may be modified to include a suitable conventional ball and socket type hardware mounting piece to enable partial or full 360° swivel action about this single pivot connection between the drive unit and the vehicle body. The drive unit then can swivel universally as an entire assembly during travel of the liftgate between fully open and fully closed positions and vice versa.

The curved track provided by housing shell components 38 and 60 and the complementary curved shape of the combined drive link and rack components 44/48/56 also provide an optimum shape to hug the interior roof structure, thereby minimizing intrusion into the cargo area of the vehicle and likewise maximizing the unobstructed load height at the liftgate opening. The direct drive of the motor fastened to the housing components, via a simple gear train encased within the drive unit clam shell housing, provides a reliable, compact and simplified drive system as compared to various prior art liftgate operating systems.

It is also to be understood that the power operating system of this system of the invention can be designed to work alone or in conjunction with a conventional gas spring strut counterbalance system. Such systems are well known in the art, with the primary adjustment being the size of the electric motor 24 when the power rotating system is used with a counterbalance system.

From the foregoing, it will be evident that many modifications and variations of the present invention may be made in light of the above teachings. It is therefore to be understood that the invention may be practiced otherwise than as specifically illustrated and described herein without departing from the spirit and scope of the appended claims.

SECOND EMBODIMENT

Figure 4:
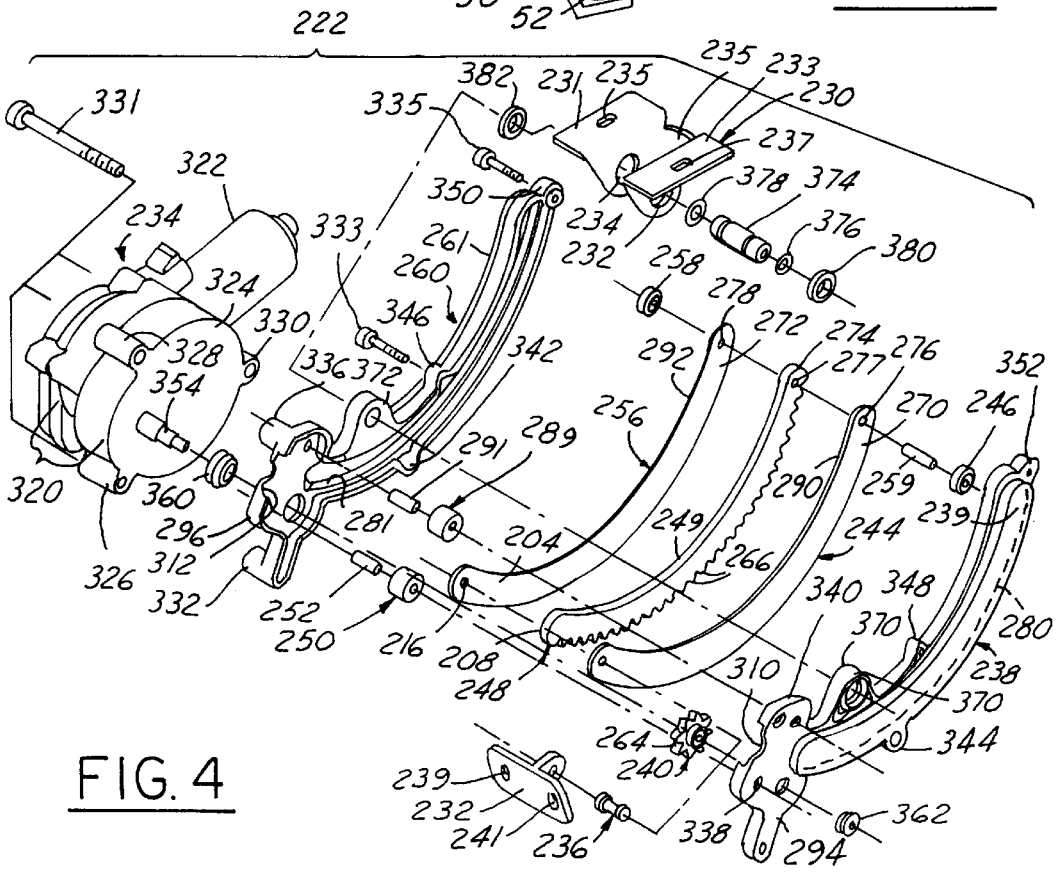
FIG. 4 is an exploded perspective view of the components of a second embodiment of the liftgate power operating system of the invention shown by themselves apart from the vehicle.
Figure 5:
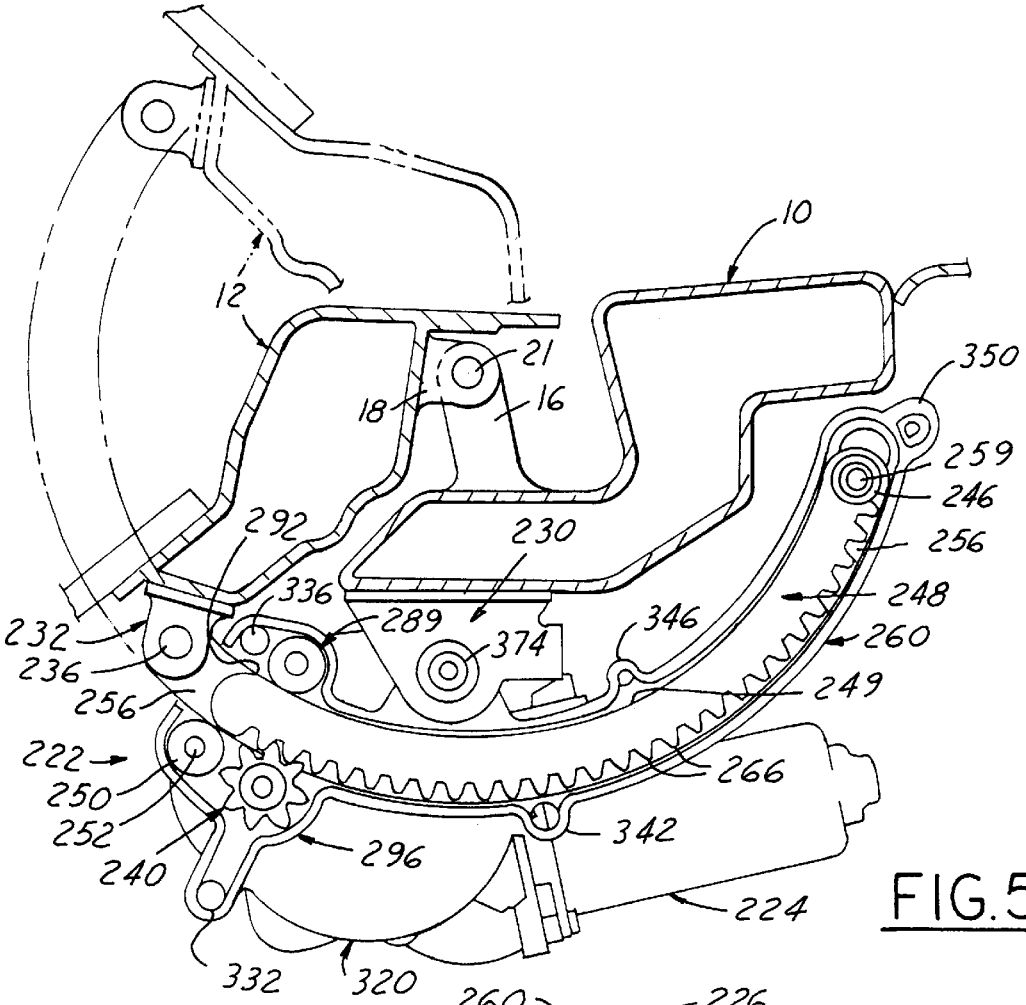
FIG. 5 is an enlarged side view of the right hand drive unit of the power operating system of FIG. 4, taken partially in cross section, and with the port side housing half-shell removed to show internal details when the liftgate is fully closed, and showing in phantom the relationship of the parts when the liftgate is fully open.
Figure 6:
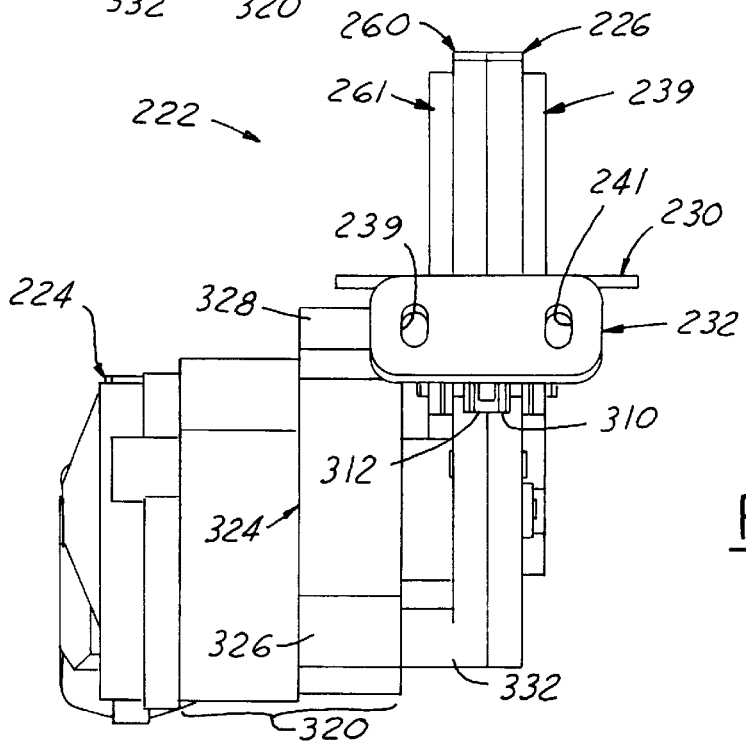
FIG. 6 is a front end elevational assembly view of the second embodiment component shown in FIGS. 4 and 5.

A second and presently preferred embodiment of the vehicle liftgate power operating system of the invention is illustrated in FIGS. 4, 5 and 6. In this embodiment, those components alike in structure and/or function to those of the first embodiment are given a like reference numeral raised by a factor of 200. Note also that in the illustrations of the second embodiment in FIGS. 4, 5 and 6 the vehicle and liftgate drive unit are turned around from their showing in FIGS. 1, 2 and 3. Hence the liftgate 12, as shown in FIGS. 4 and 5 appears to the left of vehicle 10 rather than to the right thereof as shown in FIGS. 1 and 2 relative to the first embodiment drive unit 22.

The second embodiment drive unit 222 is similar to the first embodiment drive unit 22 in having a curved housing 238/260 adapted to be attached to vehicle 10 and providing a curved internal track 280/281 nested between the two sidewalls 238 and 260 of the housing, these sidewalls again being of curved half-shell geometry to cooperate in forming a clam shell-type housing. Unit 222 also has a combined curved drive link and gear rack made up of a subassembly of gear rack segment 248 flanked by a pair of runners 244 and 256 fixedly attached thereto. The curved drive rack subassembly 244/248/256 also is roller-supported in housing 238/260 and bodily movable endwise adjacent to the curved housing. track 280/281. The curved drive link/rack 244/248/256 is adapted to be operably pivotally coupled at its forward end 204/206 to the vehicle liftgate 12 by the clevis bracket 232 and associated clevis pivot pin 236, this outer or forward end of the rack subassembly always being disposed exteriorly of the housing 238/260, as best seen in FIG. 5. The curved rack subassembly is operably guided by the rear runner-mounted rollers 246 and 248 running on curved housing track 280/281 throughout the rack travel motion, and by a set of housing-mounted guide rollers 250 and 289, as described in more detail hereinafter. Drive unit 222 also has a pinion gear 240 that is rotatably operably coupled to housing 238/260 and that drivingly engages the rack teeth 266 of the rack subassembly. Pinion gear 240 is operably rotated in such driving relation by the motor/clutch unit 224 such that the curved rack subassembly is thereby gear driven to travel in a curved working stroke along the curved track of the housing and relative to the housing and, as in the first embodiment, thereby also functions as the drive link that directly controllably moves the liftgate from and/or between its fully open and fully closed positions.

The second embodiment drive unit 222 is modified relative to the first unit 222 in several respects. The motor mounting bracket portions 294 and 296 of housing half-shells 238 and 260 respectively are relocated to the exit end of the housing half-shells, and reconfigured to cooperate with the electrically operated clutch mechanism 320 that mounts to the output side of the motor 322 of unit 224. The clutch transmission housing 324 provided with unit 224 has three mounting bolt bosses 326, 328 and 330, each provided with a through-bore for receiving an associated mounting bolt 331 therethrough (only one shown). The motor mounting bracket portion 296 of housing shell 260 is provided with two standoff legs 332 and 336 that are provided with through-holes that coaxially align with the through-holes in bosses 326 and 328 in assembly. The motor mounting bracket portion 294 of the other housing half 238 likewise is provided with holes 338 and 340 that are respectively aligned with standoffs 332 and 336 of housing half-shell 260 and with the associated bolt bosses 326 and 328 of cover 324. The third mounting boss 330 of cover 324 in assembly coaxially aligns with an apertured mounting bolt ear 342 formed as a protuberance on the underside of housing shell 260, and with a similar mounting bolt ear protuberance 344 on the underside of housing half-shell 238. Thus, the three mounting bolts already normally provided with motor/clutch unit 224 are utilized to mount this unit to housing assembly 238, 260 and to also serve as assembly fasteners for securely holding together the exit end of the housing assembly.

Housing assembly 238, 260 is further fastened together by fourth and fifth bolts 333 and 335. Bolt 33 passes through a pair of coaxially aligned upwardly protruding bolt bosses 346 and 348 that extend upwardly from the mid section of housing half shells 260 and 238 respectively, and receive fourth fastening bolt 333 therethrough to provide assembly clamping force for the housing parts in this location. The fifth mounting bolt 335 is inserted through the aligned apertures in rearwardly protruding mounting bosses 350 and 352 provided at the rear ends of housing half-shells 260 and 238 respectively.

Due to the off center and forwardly disposed location of the output shaft 354 of unit 224, the motor mounting bracket portions 294 and 296 are designed to accommodate this output shaft with an orientation of the associated drive pinion 240 disposed beneath rack gear segment 248, rather than above it as in the first embodiment. Hence, rack segment 248 is provided with a row of rack gear teeth 266 along its lower edge instead of its upper edge but again is in constant driving mesh with teeth 264 of pinion 240 as the rack 248 travels over the pinion in driven relation therewith. Preferably, housing mounting bracket portions 294 and 296 are cast or mold formed with suitable apertures to receive press-in bushings 360 and 362 that in assembly journal the output shaft 354 therein. The motor/clutch unit output shaft 354 is keyed to pinion 242 so as to rotatably drive the same bidirectionally under the control of the vehicle ECU unit.

The second embodiment drive unit 222 is also modified with respect to the roller guided support of the rack/runner subassembly 244/248/256. The rear drive rollers for the rack/runner subassembly, namely rollers 246 and 258, are journaled by axle 259 inserted through the coaxially aligned mounting holes 276, and 278 of runners 244 and 256, and are also received through a coaxially aligned aperture 277 provided at the rear end of the rack segment 248. Rollers 246 and 258 rotatably run respectively on the track surfaces 280 and 281 of housing shells 238 and 260. Note that these roller guide tracks of the housing half-shell parts are formed as laterally outwardly protruding embossment portions 239 and 261, and thus are laterally offset clear of the motor mounting and bolt boss features of the housing. These latter mounting features of the housing are thus formed in a laterally offset peripheral boundary to the embossment portions 239 and 261 and have a larger width dimension than such embossment portions. With this construction, the curved support tracks 280 and 281 for rollers 246 and 258 extend continuously for the full rack stroke without interruption by the assembly and mounting bosses and bracket portions of the housing half-shells 238 and 260.

The rack/runner subassembly 244/248/256 is roller supported and guided adjacent the exit end of the housing 238/260 by the lower and upper guide rollers 250 and 289. Lower guide roller 250 is journaled on axle 252, which in turn is press-fit at its axially opposite ends into suitable sockets cast or mold formed in motor bracket mounting portions 294 and 296. Likewise, upper guide roller 289 is journal supported on axle 291 that likewise is press-fit at its ends into suitable journal sockets formed in bracket portions 294 and 296. Lower support roller 250, like roller 50 in the first embodiment, rotatably guides and supports the rack/runner subassembly throughout its travel by the lower edges of runners 244 and 256 riding on roller 250, the rack gear teeth 266 being recessed slightly relative to these runner edges so as to clear roller 250. However, instead having dual hubs 86 and 88 of pinion 40 tracking on the upper edges of the runners as in the first embodiment, roller 289 is housing mounted such that the upper edges 290 and 292 of runners 244 and 256 respectively ride on roller 289. Preferably the upper edge 249 of gear segment rack 248 is also formed so as to track on roller 289 when in assembly with the flanking runners. It will thus be seen that the second embodiment provides precision roller guiding and low friction support for the full travel of the rack/runner subassembly during operation of unit 222.

The second embodiment liftgate operator drive unit 222 also is modified relative to the construction of the hinge bracket 230 and its mounting to the housing halves 238 and 260. Bracket 230 is preferably a one-piece stamping formed as shown in FIGS. 4 and 5, with coplanar mounting flanges 231 and 233 joined by a web portion 235 and provided with spaced-apart dependent ears that provide the journal openings 432 and 434 corresponding to journal openings 132 and 134 in bracket 30 of the first embodiment. Each of the housing half shells 238 and 260 has an upwardly protruding bracket journal ear 370 and 372 respectively that abut in assembly. Housing ears 370 and 372 are flanked by the ears of bracket 230 with the ear journal openings 432 and 434 of the bracket 230 coaxially aligned with the journal axes of bosses 370 and 372. The pivot axle 374 for pivotally coupling bracket 230 to the housing passes through the journal openings 432 and 434 of bracket 230 and is locked against axial endwise motion by retainer snap rings 376 and 378. Bushing inserts 380 and 382 are press-fit into sockets on the exterior side of bosses 370 and 372 and provide journal supports for the axially opposite ends of axle 374 in assembly.

Hinge bracket 230 has a fastener mounting opening 235 in flange 231 and a like opening 237 in flange 233. Clevis bracket 232 likewise has fastener mounting openings 239 and 241. As in the first embodiment, the major longitudinal dimension of mounting openings 235 and 237 of bracket 230 may extend in planes perpendicular to the planes of the major longitudinal dimension of clevis bracket mounting openings 239 and 241, to again provide this extent of adjustability in mounting drive unit 222 to the vehicle and liftgate.

It is to be understood that the motor/clutch unit 224 does not, as a subassembly per se, constitute a part of the present invention, but rather is a prior design originally intended for power operating vehicle windows, and developed by personnel of the assignee of record herein, Delphi Automotive Systems. Unit 224 includes a reversible D.C. electric motor 322, a built-in worm gear reduction drive unit with a right angle output relative to the rotor axis of the motor, a transmission pinion, a clutch friction plate, a rotor assembly series of components that provide for electromagnetic engagement and disengagement of the clutch and a planetary gear set that includes a transmission gear keyed to output shaft 354 that drives pinion 240.

It will be noted that in assembly the second embodiment liftgate drive unit 222 mounts this motor/gear reduction/clutch unit 224 with the axis of motor 322 parallel to the plane of the travel path of the drive link rack/runner subassembly 244–248–256. This orientation is advantageous in rendering the overall package dimensions more compact than that of first embodiment unit 22.

It is also to be understood that, in some applications, mounting bracket portions 294 and 296 of the housing half-shells may be reconfigured so as to provide for installation of the output shaft 354 of unit 224 disposed above, rather than below, the rack/runner subassembly 244/248/

256, thereby enabling the drive pinion 240 to be mounted above the path of bodily travel of this subassembly. This in turn enables the rack teeth 266 to be formed in the upper rather than lower edge of the rack segment 248, as in the case of rack segment 48 of the first embodiment. In general, the upward facing relation of the gear teeth of the rack gear is preferred from the standpoint of rendering the teeth less accessible or exposed in operation in the extended, up-position of the liftgate. Upward orientation of teeth 266 likewise is less prone to grease drippage therefrom in the rack-extended position.

The second embodiment drive unit 222 is powered and controlled for operation in the same manner as described previously in conjunction with first embodiment unit 22.

From the foregoing it will be seen that the second embodiment drive unit 222 provides all the aforestated features and advantages of the first embodiment 22, while further providing additional features in terms of a secure and rugged assembly of the housing half-shells that utilizes the existing mounting bolts of the motor drive unit 224, as well as providing rearwardly spaced bosses for two additional fasteners that ensures overall tight and secure clamping of the housing parts together in assembly and operation. The reorientation of driving pinion 240 directly beneath (or above) the rack/runner subassembly enables the additional housing-contained gear 42 of the first embodiment to be eliminated. The dual guide rollers 250 and 289 on which run the lower and upper edges of runners 244 and 256 provide a very low friction and accurate guidance system for the rack/runner subassembly, and their location adjacent pinion 240 helps ensure a constant depth mesh of the teeth of pinion 240 with the teeth 266 of rack gear 248. The continuous smooth tracking of the rear rollers 246 and 258 on the tracks 280 and 281 is retained by providing the embossed laterally offset relationship of the track embossments 239 and 261 of the housing half-shells 238 and 260. The pivotal suspension structure, in terms of mounting bracket 230, bracket pivot pin 374 and the integrally formed mounting boss ears 370 and 372 on the housing parts, provides a savings in manufacturing and assembly costs relative to the first embodiment hinge bracket 30 and associated components 26, 28, 136 and 138 and associated fastening bolts.

What is claimed is:

1. A power operating system for opening and closing a hinged vehicle liftgate that is pivotally attached to an aft end of a vehicle roof for pivotal movement between a fully open position and a fully closed position about a hinged axis, the power operating system having at least one drive unit comprising:

a housing adapted to be attached to the vehicle and having a curved track nested between two sidewalls of said housing, a curved drive rack that is partially disposed in the housing and bodily movable in the housing adjacent to the curved track, said curved drive rack having one end protruding exteriorly of said housing via an end opening of said housing, said one end being adapted to be directly pivotally coupled to the vehicle liftgate, with said one end always being disposed exteriorly of said housing, and with the curved rack being operably guided by the curved track throughout its travel motion, a pinion gear that is rotatably coupled to the housing and drivingly engaging the curved rack, and drive means operable to rotate said pinion gear such that the curved rack is thereby gear driven to travel in a curved working stroke along the curved track and relative to the housing and thereby serve as the drive link that directly moves said liftgate from and/or between said fully open and fully closed positions.

2. The system of claim 1 further including a roller at a rearward end of said curved rack that travels with a running fit in the curved track of said housing to guide said curved rack for bodily movement therein.

3. The system of claim 2 including a support roller rotatably mounted in said housing and on which an edge of said curved rack travels during bodily movement thereof and being variably spaced in operation from said roller disposed at the rearward end of said curved rack.

4. The system of claim 3 wherein said curved rack includes a pair of guide runners flanking a curved rack gear segment and disposed relative thereto such that the curved drive rack has rack teeth that are recessed inwardly of the exterior edges of said runners.

5. The system of claim 4 wherein said pinion gear has axially oppositely protruding hubs that track on the associated adjacent side edges of said runners to insure proper engagement of the teeth of said pinion with the rack teeth of said rack in a constant meshing relationship regardless of operating stresses on said system.

6. The system of claim 4 wherein said runners each extend to a distal forward end disposed beyond an associated forward end of said curved rack gear segment, said runners being operably coupled at their distal ends to a clevis pin pivotally coupled to a clevis pivot pin coupled adapted to be attached to the liftgate.

7. The system of claim 1 further including a rack roller supported on and at a rearward end of said drive curved rack that travels in the curved track of said housing with a running fit to guide the rearward end of said curved rack for bodily movement therein, and wherein a pair of support rollers are rotatably mounted in and on said housing, one adjacent each laterally opposite side edges of said curved drive rack and in proximity to said housing end opening and on which the respectively adjacent side edge of said drive curved rack travels during bodily movement thereof, said housing rollers being variably spaced in operation from said rack roller disposed at the rearward end of said curved drive rack.

8. The system of claim 7 wherein said curved drive rack includes a pair of guide runners flanking a curved rack gear segment and disposed relative thereto such that the rack teeth of the curved drive rack are recessed inwardly of the adjacent lateral side edges of said runners, said housing support rollers engaging the associated laterally opposite side edges of said runners.

9. The system of claim 8 wherein said housing support rollers are oriented to track on the associated adjacent side edges of said runners and said rearward rack roller to track on said curved track such that said support rollers insure proper engagement of the teeth of said pinion with the teeth of said curved drive rack in a constant mesh relationship regardless of operating stresses on said system.

10. The system of claim 9 wherein said drive means includes a reversible D.C. motor unit fixedly attached to one side of said housing and having a conventional worm gear reduction transmission disposed internally of said motor unit as well as an associated electrically operated clutch mechanism, with both the motor and clutch mechanism, with both the motor and clutch mechanism being adapted to be programmed and controlled by the vehicle ECU system, and wherein said motor unit has an output shaft oriented with its axis perpendicular to the travel path plane of said curved drive rack and said motor axis extends parallel to the curved drive rack travel path plane.

11. The system of claim 10 wherein said motor output shaft carries said pinion gear contained within said housing and arranged beneath said curved drive rack and operable in direct driving relationship with the teeth of said curved drive rack, said rack teeth being formed on the larger diameter curved side edge of said curved drive rack for travel on and above said pinion gear.

12. The system of claim 11 wherein said curved drive rack is adapted to constitute the sole driving link between said pinion gear and said liftgate of said drive system.

13. The system of claim 12 wherein said housing comprises a claim shell housing formed by a pair of half-shell members and wherein said motor unit has a casing with a plurality of mounting bolt bosses with individually threaded associated mounting fasteners extending parallel to said output shaft and extending through said housing half-shell members to clamp the same together and hold said motor unit on said housing.

14. The system of claim 13 wherein said housing half-shell members each have a laterally outwardly offset embossments together defining said curved track, and each member have a marginal portion surrounding the periphery of the associated embossment and provided with mounting bosses for receiving housing clamping fasteners.

15. A power operating system for opening and closing a hinged vehicle liftgate that is pivotally attached to an aft end of a vehicle roof for pivotal movement between a fully open position and a fully closed position about a hinge axis, the power operating system having at least one drive unit comprising:

a housing adapted to be attached to the vehicle and having a curved track nested between two sidewalls of said housing, a curved drive rack that is partially disposed in the housing and bodily moveable in the housing adjacent to the curved track, said curved drive rack having one end protruding exteriorly of said housing via an end opening of said housing, said one end being adapted to be directly pivotally coupled to the vehicle liftgate, with the one end always being disposed exteriorly of the housing, and with the curved rack being operably guided by the curved track throughout its travel motion, a pinion gear that is rotatably coupled to the housing and drivingly engaging the curved rack, drive means operable to rotate the pinion gear such that the curved rack is thereby gear driven to travel in a curved working stroke along the curved track and relative to the housing and thereby serve as the drive link that directly moves said liftgate between the fully open and fully closed positions, and said drive rack being adapted to be directly operably coupled at said one end to said liftgate to thereby function as both a rack gear and sole drive link in moving said liftgate from and/or between said fully closed positions.

16. A power operating system for opening and closing a hinged vehicle liftgate that is pivotally attached to an aft end of a vehicle roof for pivotal movement between a fully open position and a fully closed position about a hinge axis, the power operating system having at least one drive unit comprising:

a housing adapted to be attached to the vehicle and having a curved track nested between two sidewalls of said housing, a curved drive rack that is partially disposed in the housing and bodily moveable in the housing adjacent to the curved track, the curved drive rack having one end protruding exteriorly of the housing via an end opening of the housing, the one end being adapted to be directly pivotally coupled to the vehicle liftgate, with the one end always being disposed exteriorly of the housing, and with the curved rack being operably guided by the curved track throughout its travel motion, a pinion gear that is rotatably coupled to the housing and drivingly engaging the curved rack, drive means operable to rotate said pinion gear such that the said curved rack is thereby gear driven to travel in a curved working stroke along the curved track and relative to the housing and thereby serve as the drive link that directly moves the liftgate between the fully open and fully closed positions, and the housing being adapted to be pivotally coupled to the vehicle body by a hinge bracket coupling structure operable to provide a single pivot coupling point between the housing and the vehicle.

17. The system of claim 16 wherein said hinge bracket structure and housing are pivotally coupled for relative swinging motion about a single axis extending perpendicular to the plane of travel of said curved drive rack of said drive system.

18. The system of claim 17 wherein said drive means includes a reversible D.C. motor fixedly attached to one side of said housing and having a conventional worm gear reduction transmission disposed internally of the motor unit as well as an associated electrically operated clutch mechanism, with both the motor and clutch mechanism being adapted to be programmed and controlled by the vehicle ECU system.

19. The system of claim 18 wherein said pinion gear and an associated motor spur gear are contained within said housing and are arranged and operable as a 1:1 gear reduction relationship relative to the driving relationship with rack teeth of said rack.

20. The system of claim 19 wherein said curved drive rack is adapted to constitute the sole driving link between said pinion gear and said liftgate of said drive system.

* * * * *